137-13

9/13/77 OR 4,047,539 SR

United States Patent [19]

Kruka

[11] 4,047,539

[45] Sept. 13, 1977

[54] METHOD FOR ESTABLISHING CORE-FLOW IN WATER-IN-OIL EMULSIONS OR DISPERSIONS

[75] Inventor: Vitold R. Kruka, Houston, Tex.

[73] Assignee: Shell Oil Company, Houston, Tex.

[21] Appl. No.: 427,205

[22] Filed: Dec. 21, 1973

[51] Int. Cl.[2] ..... F17D 1/00

[52] U.S. Cl. ..... 137/13

[58] Field of Search ..... 137/13; 252/319, 360, 252/358

[56] References Cited

U.S. PATENT DOCUMENTS

| | | | |
|---|---|---|---|
| 759,374 | 5/1904 | Isaacs | 137/13 |
| 2,821,205 | 1/1958 | Chilton | 137/13 |
| 3,006,354 | 10/1961 | Sommer | 137/13 |
| 3,487,844 | 1/1970 | Simon | 137/13 |

*Primary Examiner*—Alan Cohan

[57] ABSTRACT

A viscous liquid core in less viscous liquid annulus pipe flow with less viscous liquid in viscous liquid emulsions is created without the injection of additional less viscous liquid by establishing a sufficiently high shear rate, but not to exceed a certain value, for a sufficiently long time in pipe flow to break the emulsion and create a less viscous liquid rich zone near the pipe wall, thus reducing the flow pressure drop.

2 Claims, No Drawings

METHOD FOR ESTABLISHING CORE-FLOW IN WATER-IN-OIL EMULSIONS OR DISPERSIONS

BACKGROUND OF THE INVENTION

1. Field of the Invention

Core-flow represents the pumping through a pipeline of a viscous liquid such as oil or oil emulsion, in a core surrounded by a lighter viscosity liquid, such as water, at essentially the pressure drop of the light viscosity liquid. Normally, core-flow is established by injecting the water by separate means around the viscous oil being pumped in a pipeline. The present invention involves the establishing of core-flow of less viscous liquid in viscous liquid emulsions or dispersions by creating a certain shear rate for a certain length of time in a pipe flow to break the emulsion and create a less viscous liquid rich zone near the pipe wall. Any light viscosity liquid vehicle such as water, petroleum and its distillates may be employed. Any high viscosity liquid such as petroleum and its by-products and mixtures thereof including solid components such as wax and foreign solids such as coal or concentrates, etc. are also useful.

2. Description of the Prior Art

Crude oil as it is normally produced in oil fields contains some water. Before such crude oil is pipeline transported, it is desirable that it be freed of the water. This is not difficult where the oil-water mixture contains only free water which will separate easily from the oil by merely providing a vessel in which water-oil phase separation occurs through the difference in gravities of the water and the oil. Where the water is dispersed through the oil in small particles, the separation is much more difficult. This mixture of water-in-oil may be referred to as either an emulsion or a dispersion and is highly difficult to separate into water and oil phases inasmuch as the minute particles of water are dispersed in the oil in a very stable condition. Stability exists due to the extensive area of interface between the oil and water in the emulsion.

To break emulsions in which water is dispersed in oil requires coalescing the particles of water into larger droplets which can then settle out due to gravity or be separated through other effects. This is accomplished by both physical and chemical methods which may involve the application of heat or electricity. All of the various methods proposed in the art and employed commercially for breaking emulsions and recovering the oil essentially free of the water suffer from various short comings. Among these are the incomplete separation of the oil and water and the high cost of the separation techniques which usually require several steps.

The present invention not only provides a technique which is simple for separating oil and water, as well as other viscous and less viscous liquids, but utilizes the water or other less viscous liquid once it has been separated, for transportation of the oil or other viscous liquid by a vastly improved technique which more than offsets the cost of the separation. The solution of the present invention to the problems of the prior art will become more apparent from the following description thereof.

SUMMARY OF THE INVENTION

A primary purpose of this invention resides in providing a method for establishing core-flow of less viscous liquid in viscous liquid emulsions or dispersions without the injection of additional less viscous liquid, the two liquids being substantially insoluble in each other.

The above purpose has been achieved through creating a sufficiently high shear rate for a sufficiently long time in a pipe flow to break the emulsion and create a water rich zone near the pipe wall, thus drastically reducing the flow pressure drop.

The method of this invention broadly extends to subjecting a less viscous liquid/viscous liquid emulsion to high shear to separate the less viscous liquid from the viscous liquid.

Preferably, the high shear is achieved by laminar pipe flow which causes migration of the dispersed less viscous liquid drops in the viscous liquid to an annular zone within the pipe approximately 0.6 to 0.9 radii from the pipe centerline. The migrated drops agglomerate to form a continuous less viscous liquid annulus creating the core flow.

Within the framework of the above described method, the present invention not only solves the above mentioned problems of the prior art, but also achieves further significant advantages as will be apparent from the description of preferred embodiments following.

DESCRIPTION OF PREFERRED EMBODIMENTS

The method of the present invention provides for the creation of a viscous liquid core in less viscous liquid annulus pipe flow with less viscous liquid in viscous liquid emulsions without the injection of additional less viscous liquid. Viscous water-in-oil emulsions are frequently produced during thermal secondary recovery of viscous crude oils. The present invention provides a superior method for separating water from such crude oils. More particularly, the present invention is highly beneficial in cases where such emulsions are to be transported by a core-flow technique. The present state of the art teaches the injection of the emulsion into a pipeline and surrounding the emulsion with additional water. Such a procedure is inferior to the method disclosed hereinafter inasmuch as it requires the use of additional water and additional horsepower to move a larger quantity of combined fluids.

The present method involves creating a substantially high shear rate for a long enough time to break the emulsion and separate it into viscous liquid (oil) and less viscous liquid (water) phases. The shear rate, however, must not approach or exceed the value beyond which emulsification of the viscous liquid and less viscous liquid will occur. The required shearing forces may be applied to the emulsion in a number of ways, such as by agitating the emulsion with mechanical agitating means such as impellers or other devices. However, it is preferred to apply shearing forces to the emulsion by means of pipe flow inasmuch as this creates core-flow by establishing a less viscous liquid rich zone near the pipe wall which thus drastically reduces the flow pressure drop in the pipeline. Irrespectful of the combination of means employed to apply the shearing force to the emulsion, enough shearing force must be imparted to the emulsion for a sufficiently long time to coalesce the less viscous liquid. The amount of work required for coalescing strongly depends on the viscosity of the emulsion and varies between about 0.05 and about 50,000 foot-pounds per pound of emulsion. The use of additional amounts of shearing work usually produces no added benefit for the extra cost and may be harmful in that it may lead to re-emulsification. Similarly, the use of less than about 0.05 foot-pounds of shearing work per pound of emulsion also does not produce any desired result in coalescing the less viscous liquid (water).

The present invention is particularly useful in removing water from a wide variety of viscous crude oils. If the crude oil is subject to being passed through a pipeline, then the present invention can be employed to separate the water and oil phases therein. At the other extreme, if the crude oil is so light as not to require the use of core-flow, the present invention may not be needed for the separation of water to form an annular layer for purposes of core-flow, but on the other hand, it may be utilized solely for effecting separation of water from the oil, which likewise applies to the separation of other viscous and less viscous liquids. Accordingly, the invention is considered useful with viscous emulsions of various liquids ranging in viscosity from about 10 to about 1,000,000 cs, or more preferably from about 100 to about 500,000 cs. The invention is useful with emulsions containing a minor to a large quantity of less viscous liquid. Specifically, the less viscous liquid content may range from about 5 to about 60%v, or more preferably from about 10 to about 55%v. Generally, if the viscous liquid contains less than about 5%v, it is feasible to separate out the water by use of the present invention to form a purified viscous liquid, but on the other hand, there may not be enough water to allow core-flow of the viscous liquid inside a less viscous liquid annulus. In this circumstance, some additional water may be injected into the flow so as to achieve core-flow. At the other extreme, if the viscous liquid contains more than 60%v less viscous liquid, there is too much less viscous liquid so that core-flow may not be economically effected. In this latter circumstance, some of the less viscous liquid may be separated, removed and sent to disposal, and the remaining less viscous liquid retained for core-flow purposes.

It is preferable to employ the present invention with laminar pipe flow, although turbulent flow may be utilized. Generally, such flow is established that the shear rate, based on zero-shear viscosity, is maintained between about 2 and about 5000 l/sec. Preferably, the shear rate is maintained at about 5 to about 500 l/sec. Under these conditions, the length of the tube, pipe, or other means for establishing flow is such that the residence time of the emulsion in the tube is sufficient to allow migration of the suspended less viscous liquid droplets. Generally, the minimum required residence times, depending upon the percentage of water, the viscosity of the viscous liquid, temperatures, pressure, and diameter of pipe, is from about 0.1 to about 200 seconds. A more preferred range is from about 2 to about 100 seconds. The longer residence times allow the use of lower shear rates.

After the emulsion is passed through the core-flow creating tube or pipe, the pipe may be increased in size by means of a conical diffusor, decreased in size by an inverted diffusor or continued in the same size pipe. The choice, of course, depends upon the desired pipeline flow rate. A fast rate tends to destroy core-flow inasmuch as the swirls and eddy currents in the viscous liquid and less viscous liquid layers tend to cause intermixing of the two whereby the viscous liquid and less viscous liquid are re-emulsified and core-flow is lost. On the other hand, a very slow rate also tends to destroy core-flow inasmuch as at such rates gravitational effects overcome the weak secondary flows suspending the viscous liquid within the less viscous liquid annulus and allow the viscous liquid to touch the pipe wall leading to the loss of core-flow. Thus, a flow rate must be chosen which tends to maintain the best core-flow throughout the length of the pipeline. Once it is decided to either decrease or increase the pipe size, the diffusor to be employed preferably has an angle of from 1° to 30° and more preferably from about 1° to about 9° to avoid re-emulsification due to flow separation.

The present invention is of great assistance in dewatering crude oil, or separating other viscous liquids and less viscous liquids at the termination of the pipeline. Thus, the water broken out of the emulsion and used for core-flow is free water and will settle out when flow is stopped in storage tanks. Accordingly, the load on heater-treaters normally employed to break viscous water-in-oil emulsions is reduced.

Finally, the present invention solves the problem of passage of a core-flow system through booster pumps in a pipeline without prior separation of the less viscous liquid from the viscous liquid or additional less viscous liquid injection after the booster pump. The highly intense turbulent shear present in centrifugal pumps or the less intense shear present in positive displacement pumps tends to disperse, and sometimes emulsify, the annular less viscous liquid with the viscous liquid. U.S. Pat. No. 2,821,205 teaches that the oil and water must be separated prior to passage through the booster pump in order to avoid such emulsification. The alternative solution to this is that new water or other less viscous liquid be added after the booster pump to continue core-flow of an emulsion. The present invention eliminates this need for either water-oil separation or the use of additional water inasmuch as the present invention allows the reformation of core-flow even though pumps have tended to emulsify or disperse the water in the oil.

EXAMPLES

The method of the invention was demonstrated in 0.500 inch I.D. steel tube 53.5 inches long. The tube was connected to a pressure vessel suspended from a load cell. The load cell served to indicate the flow rate. The emulsion was charged to the pressure vessel, the vessel was then pressurized to the desired level and flow was initiated by opening a discharge valve. A normal sequence of tests with one emulsion was initiated at a low pressure and the pressure was increased until core-flow was established. In some tests, the pressure was subsequently decreased to show that core-flow continued to be maintained.

Test 1

Oil : Midway-Sunset crude oil
Water content in oil : 10%v
Emulsion low shear viscosity : 5,200 cs
Emulsion specific gravity : 0.97

| Run # | Supply Tank Pressure (psi) | Flow Rate (cm/sec) | Flow Condition |
|---|---|---|---|
| 1 | 5 | 3.22 | Shear Thinning Laminar |
| 2 | 6 | 4.15 | Shear Thinning Laminar |
| 3 | 7 | 5.56 | Shear Thinning Laminar |
| 4 | 8 | 7.15 | Shear Thinning Laminar |
| 5 | 9 | 8.86 | Shear Thinning Laminar |
| 6 | 10 | 10.82–112.10 | Intermittant Core-Flow |
| 7 | 11 | 199.30 | Steady Core-Flow |

Test 2

Oil : Midway-Sunset crude oil
Water content in oil : 10%v
Emulsion low shear viscosity : 45,000 cs
Emulsion specific gravity : 0.984

| Supply Tank Pressure | Flow Rate |
|---|---|

-continued

| Run # | (psi) | (cm/sec) | Flow Condition |
|---|---|---|---|
| 1 | 20 | 0.94 | Shear Thinning Laminar |
| 2 | 25 | 1.29 | Shear Thinning Laminar |
| 3 | 40 | 2.13 | Shear Thinning Laminar |
| 4 | 55 | 3.24 | Shear Thinning Laminar |
| 5 | 70 | 4.30–26.47 | Intermittant Core-Flow |
| 6 | 55 | 27.80 | Steady Core-Flow |

Test 3

| | | |
|---|---|---|
| Oil | : | Midway-Sunset crude oil |
| Water content in oil | : | 10%v |
| Emulsion low shear viscosity | : | 80,000 cs |
| Emulsion specific gravity | : | 0.985 |

| Run # | Supply Tank Pressure (psi) | Flow Rate (cm/sec) | Flow Condition |
|---|---|---|---|
| 1 | 9 | 0.32 | Shear Thinning Laminar |
| 2 | 27 | 1.12 | Shear Thinning Laminar |
| 3 | 30 | 1.35 | Shear Thinning Laminar |
| 4 | 40 | 1.78 | Shear Thinning Laminar |
| 5 | 50 | 2.46–35.20 | Intermittant Core-Flow |
| 6 | 25 | 20.20 | Steady Core-Flow |
| 7 | 15 | 23.37 | Steady Core-Flow |

I claim as my invention:

1. A method for breaking an emulsion of a viscous liquid and less viscous liquid and establishing core-flow of the viscous liquid inside an annulus of the less viscous liquid comprising subjecting the emulsion to a high shear rate by laminar conduit flow and maintaining the shear rate for a residence time of the emulsion in the conduit sufficient to cause migration of a substantial quantity of the less viscous liquid to the proximity of the conduit wall and there agglomerate to form the less viscous liquid annulus, and continuing flow in a conduit of larger diameter without substantially disrupting core-flow of the viscous liquid inside the less viscous liquid by diffusing and slowing flow from the emulsion-breaking conduit into the larger conduit by means of a diffuser having an angle ranging from about 1° to about 30°.

2. A method for breaking an emulsion of a viscous liquid and less viscous liquid and establishing core-flow of the viscous liquid inside an annulus of the less viscous liquid comprising subjecting the emulsion to a high shear rate by laminar conduit flow and maintaining the shear rate for a residence time of the emulsion in the conduit sufficient to cause migration of a substantial quantity of the less viscous liquid to the proximity of the conduit wall and there agglomerate to form the less viscous liquid annulus, and continuing flow in a conduit of larger diameter without substantially disrupting core-flow of the viscous liquid inside the less viscous liquid by diffusing and slowing flow from the emulsion-breaking conduit into the larger conduit by means of a diffuser having an angle ranging from about 1° to about 9°.

* * * * *